US009945088B2

(12) United States Patent
Kijima et al.

(10) Patent No.: US 9,945,088 B2
(45) Date of Patent: Apr. 17, 2018

(54) STEEL PIPE PILE WITH SPIRAL BLADES, COMPOSITE PILE, AND CONSTRUCTION METHOD OF COMPOSITE PILE

(71) Applicant: ASAHI KASEI CONSTRUCTION MATERIALS CORPORATION, Tokyo (JP)

(72) Inventors: Yosuke Kijima, Tokyo (JP); Daisuke Ito, Tokyo (JP); Kenichi Nakahama, Tokyo (JP)

(73) Assignee: ASAHI KASEI CONSTRUCTION MATERIALS CORPORATION, Tokyo (JP)

( * ) Notice: Subject to any disclaimer, the term of this patent is extended or adjusted under 35 U.S.C. 154(b) by 0 days.

(21) Appl. No.: 15/126,932

(22) PCT Filed: Mar. 16, 2015

(86) PCT No.: PCT/JP2015/057751
§ 371 (c)(1),
(2) Date: Sep. 16, 2016

(87) PCT Pub. No.: WO2015/141639
PCT Pub. Date: Sep. 24, 2015

(65) Prior Publication Data

US 2017/0089024 A1 Mar. 30, 2017

(30) Foreign Application Priority Data

Mar. 19, 2014 (JP) ..... 2014-057201

(51) Int. Cl.
*E02D 5/28* (2006.01)
*E02D 5/56* (2006.01)
(Continued)

(52) U.S. Cl.
CPC ..... *E02D 5/56* (2013.01); *E02D 5/22* (2013.01); *E02D 5/28* (2013.01); *E02D 7/22* (2013.01);
(Continued)

(58) Field of Classification Search
CPC .. E02D 5/56; E02D 5/801; E02D 7/22; E21B 7/22
(Continued)

(56) References Cited

U.S. PATENT DOCUMENTS

2013/0101360 A1* 4/2013 Lutenegger ..... E02D 7/22 405/252.1
2013/0227897 A1* 9/2013 Palmer ..... E02D 27/42 52/157

FOREIGN PATENT DOCUMENTS

JP 1-142122 A 6/1989
JP 2000-54375 A 2/2000
(Continued)

OTHER PUBLICATIONS

English translation of the International Preliminary Report on Patentability and the Written Opinion of the International Searching Authority, dated Sep. 29, 2016, for International Application No. PCT/JP2015/057751.
(Continued)

*Primary Examiner* — Frederick L Lagman
*Assistant Examiner* — Stacy N Warren
(74) *Attorney, Agent, or Firm* — Birch, Stewart, Kolasch & Birch, LLP

(57) ABSTRACT

There is disclosed a steel pipe pile with spiral blades which is capable of effectively improving comparatively soft ground in which a clay layer and the like are present at deep positions of several ten meters beneath the surface of the ground. A steel pipe pile 1 with spiral blades comprises a
(Continued)

steel pipe pile main body 10 and one or more spiral blades 20 attached to the steel pipe pile main body 10, and a diameter D of the spiral blade 20 is set to three times or more as large as a diameter d of the steel pipe pile main body 10.

8 Claims, 10 Drawing Sheets

(51) Int. Cl.
*E02D 7/22* (2006.01)
*E02D 5/22* (2006.01)
*E02D 5/46* (2006.01)

(52) U.S. Cl.
CPC ..... *E02D 5/46* (2013.01); *E02D 2250/0023* (2013.01); *E02D 2300/002* (2013.01); *E02D 2300/0029* (2013.01); *E02D 2300/0045* (2013.01)

(58) Field of Classification Search
USPC ..... 405/252.1; 175/323; 52/157
See application file for complete search history.

(56) References Cited

FOREIGN PATENT DOCUMENTS

| | | | |
|---|---|---|---|
| JP | 2000-154537 | A | 6/2000 |
| JP | 2001-311147 | A | 11/2001 |
| JP | 2001-317050 | A | 11/2001 |
| JP | 2002-348864 | A | 12/2002 |
| JP | 2003-96771 | A | 4/2003 |
| JP | 2004-332431 | A | 11/2004 |
| JP | 3188808 | U | 11/2004 |
| KR | 10-0869815 | B1 | 11/2008 |

OTHER PUBLICATIONS

International Search Report for PCT/JP2015/057751 dated Jun. 9, 2015.

European Search Report dated Feb. 9, 2017 for Application No. 15764641.5.

* cited by examiner

STEEL PIPE PILE WITH SPIRAL BLADES, COMPOSITE PILE, AND CONSTRUCTION METHOD OF COMPOSITE PILE

TECHNICAL FIELD

The present invention relates to a steel pipe pile with spiral blades, a composite pile, and a construction method of the composite pile.

BACKGROUND ART

At present, a large variety of methods of constructing composite piles to improve ground have been suggested and put to practical use. For example, there has been suggested a technology in which the ground and slurry are mechanically stirred and mixed by a stirring mixing device while injecting the slurry including cement as a main component into the ground, to construct a soil cement column body. Furthermore, a steel pipe pile with spiral blades is twisted and inserted into the soil cement column body prior to curing, and integrated with the column body, thereby constructing the composite pile (e.g., see Patent Documents 1 and 2).

CITATION LIST

Patent Document

Patent Document 1: JP2001-317050
Patent Document 2: JP2003-096771

SUMMARY

Technical Problem

Furthermore, in recent years, technologies to improve ground have been developed in neighboring countries of Southeast Asia and the like.

It is known that the ground of Japan is comparatively firm (e.g., a firm support layer is present at a shallow position of about several meters beneath the surface of the ground), which varies with districts. However, in the grounds of Southeast Asian countries (e.g., Vietnam), clay and sand layers are present at deep positions of several ten meters beneath the surface of the ground, and hence the grounds are comparatively soft. Therefore, in recent years, it has become clear that such conventional composite pile construction technologies as described in Patent Documents 1 and 2 are not necessarily effective for the improvement of the soft ground in the other countries.

The present invention has been developed in view of such situations, and an object thereof is to provide: a steel pipe pile with spiral blades which is capable of effectively improving the comparatively soft ground in which a clay layer and the like are present at deep positions of several ten meters beneath the surface of the ground; and a composite pile using the steel pipe pile with the spiral blades.

Solution to Problem

To achieve the object, a steel pipe pile with spiral blades according to the present invention comprises a steel pipe pile main body and one or more spiral blades attached to this steel pipe pile main body, and a diameter (D) of the spiral blade is set to three times or more as large as a diameter (d) of the steel pipe pile main body.

When such a constitution is employed, the diameter (D) of the spiral blade is set to three times or more as large as the diameter (d) of the steel pipe pile main body, so that a peripheral area of a pile (a composite pile) constructed by using the steel pipe pile with the spiral blades can be enlarged. Therefore, a support force of the composite pile can be improved, and hence the soft ground can effectively be improved. In a conventional steel pipe pile with spiral blades, an upper limit of a diameter (D) of the spiral blade is determined in consideration of a size of an insertion resistance caused by the comparatively firm ground of our country. Furthermore, from the viewpoint of an earthquake resistance, a lower limit of a diameter (d) of a steel pipe pile main body which receives and holds a horizontal load is determined, and hence the diameter (D) of the spiral blade has been set to be from about 1.5 times to 2.5 times as large as the diameter (d) of the steel pipe pile main body. On the other hand, in the present steel pipe pile assumed for improvement of the comparatively soft ground of another country in which a clay layer and the like are present at deep positions of several ten meters beneath the surface of the ground, the insertion resistance or the earthquake resistance does not have to be taken into consideration. Therefore, the diameter (D) of the spiral blade can relatively be enlarged, and the diameter (d) of the steel pipe pile main body can relatively be reduced. Consequently, manufacturing costs (a material cost, etc.) of the steel pipe pile main body can be decreased.

In the steel pipe pile with the spiral blades according to the present invention, the diameter (D) of the spiral blade is preferably set to three times or more and four times or less as large as the diameter (d) of the steel pipe pile main body.

When such a constitution is employed, a proper support force can be acquired while relatively reducing the diameter (d) of the steel pipe pile main body and decreasing the manufacturing cost. When the diameter (D) of the spiral blade is in excess of four times as large as the diameter (d) of the steel pipe pile main body (the steel pipe pile main body is excessively made thin), the proper support force would not be acquired, which is unfavorable.

In the steel pipe pile with the spiral blades according to the present invention, the spiral blade is preferably constituted of a distal blade attached to a distal portion of the steel pipe pile main body and intermediate blades attached to portions of the steel pipe pile main body excluding the distal portion thereof, and a length ($L_1$) between the distal blade and the intermediate blade present at the lowermost end is preferably set to 2.0 m or more. Furthermore, a length ($L_m$) between the intermediate blades is preferably set to 3.0 m or more, and a length ($L_2$) between the intermediate blade present at the uppermost end and a pile head portion of the steel pipe pile main body is preferably set to 0.3 m or more and 0.5 m or less.

When such a constitution is employed, both of the length ($L_1$) between the distal blade and the lowermost-end intermediate blade and the length ($L_m$) between the intermediate blades are set to be comparatively long. Therefore, the number of the spiral blades to a pile length can be decreased to improve a construction performance (rise of an insertion speed, increase of a maximum construction length, reduction of a construction period and the like can be realized). Additionally, costs for a support force performance (a material cost, a welding cost, a processing cost, etc.) can remarkably be reduced. Furthermore, the length ($L_2$) between the uppermost-end intermediate blade and the pile head portion is set to be comparatively short, and hence a resistance force to a horizontal load can be enlarged. As a result, it is possible to realize both of the improvement of the construction performance and maintenance of a support force. Furthermore, due to the decrease of the number of the spiral blades, a volume ratio of the steel pipe pile in a soil cement column body decreases, and hence an amount of surplus soils to be generated decreases. As a result, a surplus soil treatment cost can be saved.

When the length ($L_1$) between the distal blade and the lowermost-end intermediate blade is smaller than 2.0 m and the length ($L_m$) between the intermediate blades is smaller than 3.0 m, the number of the spiral blades to the pile length unfavorably increases. When the length ($L_2$) between the uppermost-end intermediate blade and the pile head portion is smaller than 0.3 m, it unfavorably becomes difficult to interpose a member such as a pile cap between the uppermost-end intermediate blade and the pile head portion of the steel pipe pile main body. On the other hand, when the length ($L_2$) between the uppermost-end intermediate blade and the pile head portion is in excess of 0.5 m, the resistance force to the horizontal load cannot sufficiently be acquired, which is unfavorable.

In the steel pipe pile with the spiral blades according to the present invention, the length ($L_1$) between the distal blade and the intermediate blade present at the lowermost end is preferably set to twice or more as large as the length ($L_2$) between the intermediate blade present at the uppermost end and the pile head portion of the steel pipe pile main body, and the length ($L_m$) between the intermediate blades is preferably set to three times or more as large as the length ($L_2$) between the intermediate blade present at the uppermost end and the pile head portion of the steel pipe pile main body.

When such a constitution is employed, both of the length ($L_1$) between the distal blade and the lowermost-end intermediate blade and the length ($L_m$) between the intermediate blades are set to be comparatively long, and hence the number of the spiral blades to the pile length can be decreased to improve the construction performance. Furthermore, the length ($L_2$) between the uppermost-end intermediate blade and the pile head portion is set to be comparatively short, and hence the resistance force to the horizontal load can be enlarged.

When the length ($L_1$) between the distal blade and the lowermost-end intermediate blade is smaller than twice as large as the length ($L_2$) between the uppermost-end intermediate blade and the pile head portion and when the length ($L_m$) between the intermediate blades is smaller than three times as large as the length ($L_2$) between the uppermost-end intermediate blade and the pile head portion, the number of the spiral blades to the pile length unfavorably increases.

The steel pipe pile with the spiral blades according to the present invention can comprise a plurality of plate-like reinforcing ribs arranged radially around the steel pipe pile main body on an upper surface of the spiral blade.

When such a constitution is employed and the steel pipe pile with the spiral blades is twisted into the soil cement column body, it is possible to withstand a reaction force (bending moment) which acts from cement or the like, and hence a thickness of the spiral blade can be decreased. Furthermore, a stirring effect can be obtained.

In the steel pipe pile with the spiral blades according to the present invention, the reinforcing ribs each possessing a substantially trapezoidal shape in planar view are employed, each of the ribs is disposed so that a first side as its long side abuts on an outer peripheral surface of the steel pipe pile main body, the rib is disposed so that a second side as its short side is separated from the steel pipe pile main body, the rib is disposed so that a third side which is at right angles with the first side and the second side abuts on the upper surface of the spiral blade, and a notch portion can be formed in a corner portion formed by the first side and the third side.

When such a constitution is employed, the notch portion is formed in the corner portion formed by the first side and the third side of the reinforcing rib. Therefore, when the steel pipe pile with the spiral blades is twisted into the soil cement column body, it is possible to inhibit the cement or the like from being retained in the corner portion formed by the first side and the third side of the reinforcing rib, and it is possible to decrease the insertion resistance.

Furthermore, a construction method of a composite pile according to the present invention comprises a step of inserting the steel pipe pile with the spiral blades into a soil cement column body constructed in the ground.

Furthermore, a composite pile according to the present invention is formed by inserting the steel pipe pile with the spiral blades into a soil cement column body constructed in the ground.

In the composite pile according to the present invention, a length from the deepest position of the soil cement column body to a distal end position of the steel pipe pile with the spiral blades is preferably set to 0.2 m or more.

When such a constitution is employed, the length (a column extra length) from the deepest position of the soil cement column body to the distal end position of the steel pipe pile with the spiral blades is set to 0.2 m or more, and hence a distal end support force of the composite pile can sufficiently be acquired. When the column extra length is smaller than 0.2 m, the distal end support force cannot sufficiently be acquired, which is unfavorable.

Advantageous Effects of Invention

According to the present invention, it is possible to provide: a steel pipe pile with spiral blades which is capable of effectively improving the comparatively soft ground in which a clay layer and the like are present at deep positions of several ten meters beneath the surface of the ground; and a composite pile using the steel pipe pile.

DESCRIPTION OF EMBODIMENTS

Hereinafter, embodiments of the present invention will be described with reference to the drawings. It is to be noted that the following embodiments are merely preferable application examples, and a scope in which the present invention is applied is not limited to these examples.

Figure 1:
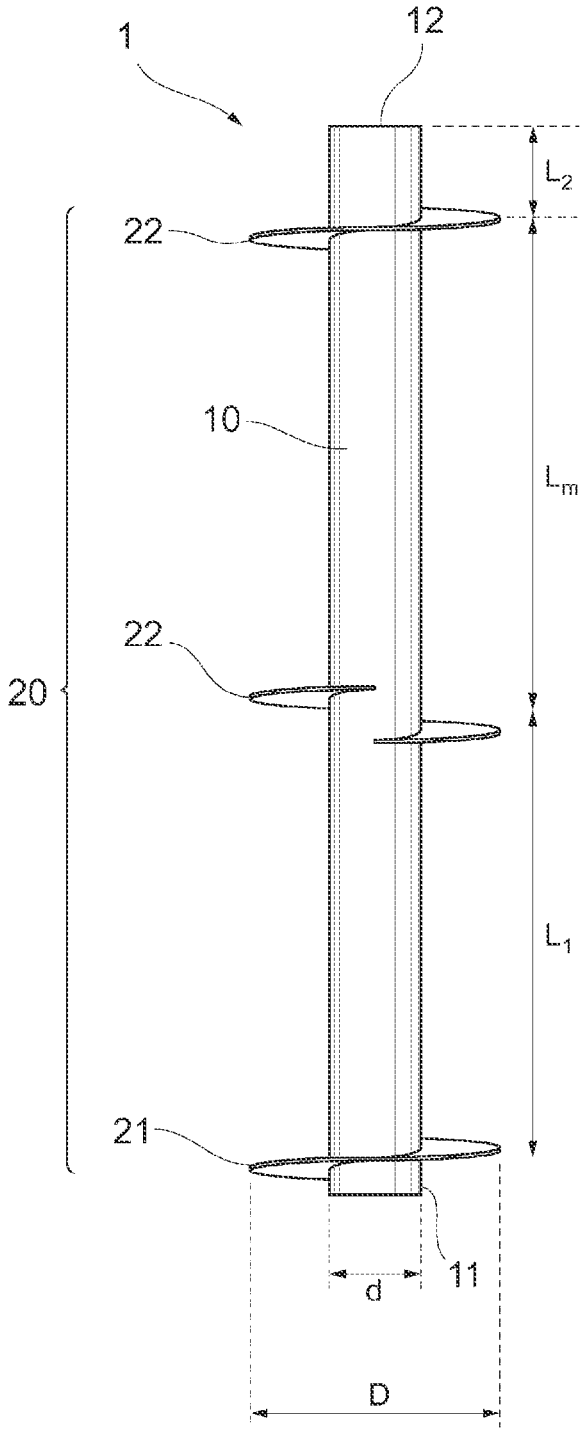
FIG. 1 is an explanatory view to explain a constitution of a steel pipe pile with spiral blades according to an embodiment of the present invention.

First, a constitution of a steel pipe pile 1 with spiral blades according to the present embodiment (hereinafter referred to as "the present steel pipe pile") will be described with reference to FIG. 1 to FIG. 6. As shown in FIG. 1, the present steel pipe pile 1 comprises a steel pipe pile main body 10 which is a hollow pipe made of a metal, and a plurality of spiral blades 20 attached to the steel pipe pile main body 10.

The steel pipe pile main body 10 can be constituted of steel containing five elements (common elements) of carbon (C), silicon (Si), manganese (Mn), phosphorous (P) and sulfur (S). Furthermore, for the purpose of improving a weather resistance and an acid resistance, the steel pipe pile main body 10 may be constituted of steel to which special elements such as copper (Cu), nickel (Ni), chromium (Cr) and molybdenum (Mo) are added. At this time, as a ratio (a weight) of each of the special elements to be added, for example, each of the ratios of copper (Cu), nickel (Ni) and chromium (Cr) can be set to about 0.40%, and the ratio of molybdenum (Mo) can be set to about 0.15%.

Figure 3:
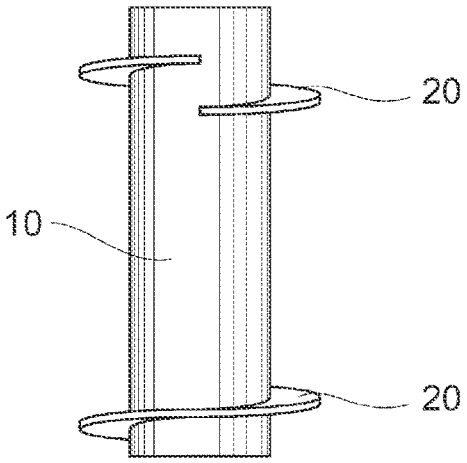
FIG. 3 is an explanatory view to explain attaching positions of the spiral blades in the steel pipe pile with the spiral blades shown in FIG. 1.
Figure 4:
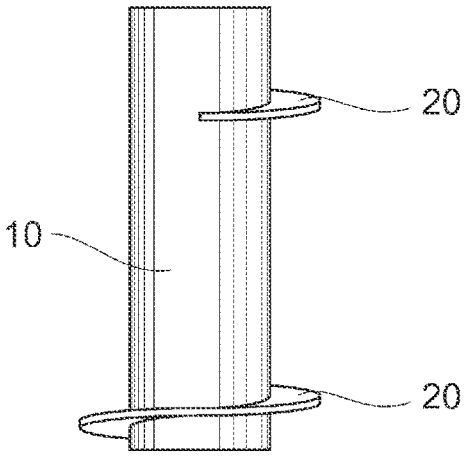
FIG. 4 is an explanatory view to explain an example where the attaching positions of the spiral blades are changed.
Figure 5:
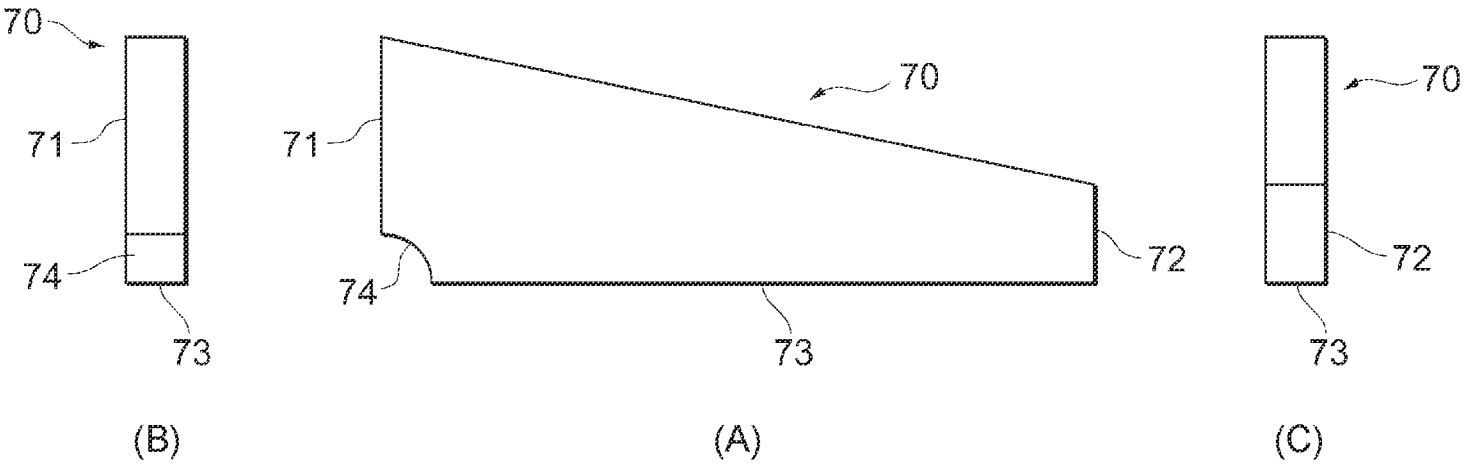
FIG. 5 shows a reinforcing rib to be attached to the spiral blade, (A) is a front view of the reinforcing rib, (B) is a side view of the reinforcing rib seen from the side of its long side, and (C) is a side view of the reinforcing rib seen from the side of its short side.

As shown in FIG. 1, the spiral blades 20 are constituted of a distal blade 21 attached to a distal portion 11 of the steel pipe pile main body 10, and intermediate blades 22 attached to portions of the steel pipe pile main body 10 excluding the distal portion 11 thereof. The spiral blades 20 can be constituted of the same material as the steel pipe pile main body 10. In the present embodiment, as shown in FIG. 3, the adjacent spiral blades 20 are attached to the steel pipe pile main body 10 in a state where the blades are rotated by 180°. When the spiral blades 20 are attached in this manner, the present steel pipe pile 1 can be twisted into an after-mentioned soil cement column body 2 (FIG. 7) with good balance. It is to be noted that as shown in FIG. 4, the adjacent spiral blades 20 can be attached to the steel pipe pile main body 10 in a state where the blades are rotated by 90°.

Figure 2:
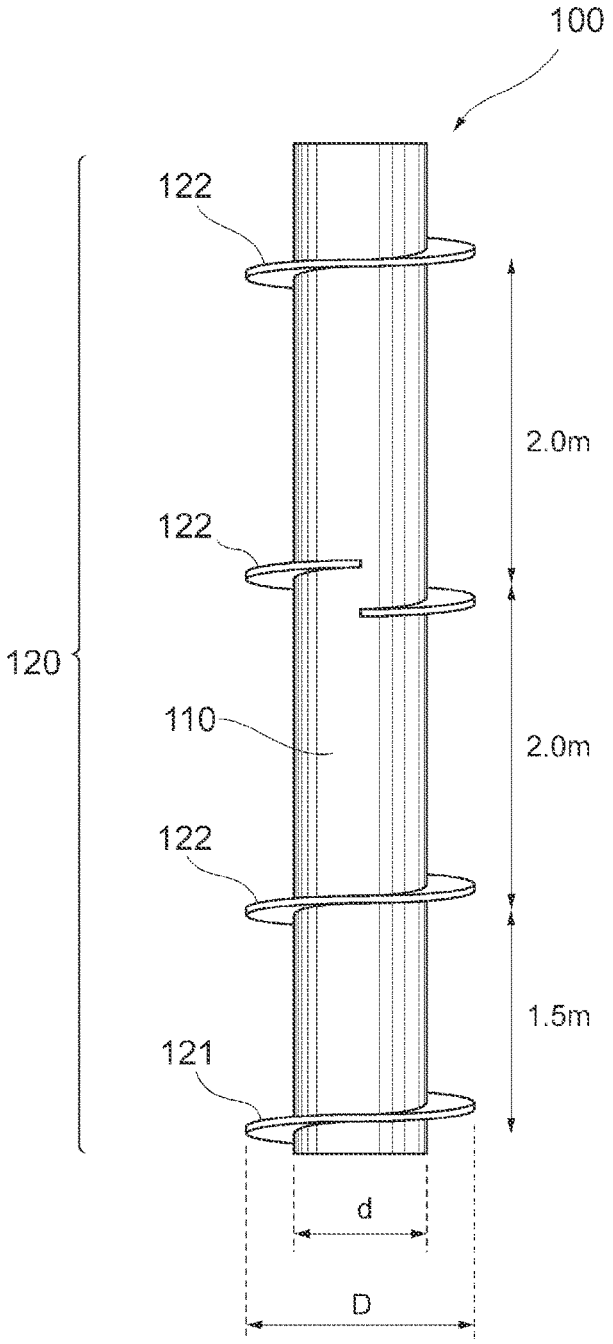
PRIOR ART FIG. 2
FIG. 2 is an explanatory view to explain a constitution of a conventional steel pipe pile with spiral blades.

In the present embodiment, a diameter D of each of the spiral blades 20 is set to three times or more as large as a diameter d of the steel pipe pile main body 10. In this case, a peripheral area of a composite pile constructed by using the present steel pipe pile 1 can be enlarged. In a conventional steel pipe pile 100 with spiral blades (hereinafter referred to as "the conventional pile"), as shown in FIG. 2, an upper limit value of a diameter D of a spiral blade 120 and a lower limit value of a diameter d of a steel pipe pile main body 110 are determined in consideration of an earthquake resistance and an insertion resistance, and the conventional pile is restricted so that the diameter D of the spiral blade 120 is from about 1.5 times to 2.5 times as large as the diameter d of the steel pipe pile main body 110. On the other hand, in the present steel pipe pile 1 assumed for improvement of the comparatively soft ground of another country (e.g., Vietnam) in which a clay layer and the like are present at deep positions of several ten meters beneath the surface of the ground, the earthquake resistance or the insertion resistance does not have to be taken into consideration. Therefore, the diameter D of the spiral blade 20 can relatively be enlarged, and the diameter d of the steel pipe pile main body 10 can relatively be reduced. Consequently, manufacturing costs (a material cost, etc.) of the steel pipe pile main body 10 can be decreased.

The diameter D of each of the spiral blades 20 is preferably set to three times or more and four times or less as large as the diameter d of the steel pipe pile main body 10. In this case, a proper support force can be acquired while relatively reducing the diameter d of the steel pipe pile main body 10 and decreasing the manufacturing cost. When the diameter D of the spiral blade 20 is in excess of four times as large as the diameter d of the steel pipe pile main body 10 (the steel pipe pile main body 10 is excessively made thin), the proper support force would not be acquired, which is unfavorable.

Furthermore, in the present embodiment, a length $L_1$ between the distal blade 21 and an intermediate blade 22 present at the lowermost end is set to 2.0 m or more (e.g., 2.5 m), and a length $L_m$ between the intermediate blades 22 is set to 3.0 m or more (e.g., 3.0 m). Furthermore, a length $L_2$ between the intermediate blade 22 present at the uppermost end and a pile head portion 12 of the steel pipe pile main body 10 is set to 0.3 m or more and 0.5 m or less (e.g., 0.5 m). In the conventional pile 100, as shown in FIG. 2, a length between a distal blade 121 and a lowermost-end intermediate blade 122 is set to about 1.5 m, and a length between the intermediate blade 122 and another intermediate blade 122 is set to about 2.0 m. On the other hand, in the present steel pipe pile 1, both of the length $L_1$ between the distal blade 21 and the lowermost-end intermediate blade 22 and the length $L_m$ between the intermediate blades 22 are set to be comparatively long, so that the number of the spiral blades 20 to a pile length can be decreased. Furthermore, the length $L_2$ between the uppermost-end intermediate blade 22 and the pile head portion 12 is set to be comparatively short, so that a resistance force to a horizontal load can be enlarged.

When the length $L_1$ between the distal blade 21 and the lowermost-end intermediate blade 22 is smaller than 2.0 m and the length $L_m$ between the intermediate blades 22 is smaller than 3.0 m, the number of the spiral blades 20 to the pile length unfavorably increases. When the length $L_2$ between the uppermost-end intermediate blade 22 and the pile head portion 12 is smaller than 0.3 m, it unfavorably becomes difficult to interpose a member such as a pile cap between the uppermost-end intermediate blade 22 and the pile head portion 12. On the other hand, when the length $L_2$ between the uppermost-end intermediate blade 22 and the pile head portion 12 is in excess of 0.5 m, the resistance force to the horizontal load cannot sufficiently be acquired, which is unfavorable.

The length $L_1$ between the distal blade 21 and the lowermost-end intermediate blade 22 is preferably set to twice or more (e.g., five times) as large as the length $L_2$ between the uppermost-end intermediate blade 22 and the pile head portion 12. Furthermore, the length $L_m$ between the intermediate blades 22 is preferably set to three times or more (e.g., six times) as large as the length $L_2$ between the uppermost-end intermediate blade 22 and the pile head portion 12. In this case, both of the length $L_1$ between the distal blade 21 and the lowermost-end intermediate blade 22 and the length $L_m$ between the intermediate blades 22 are set to be comparatively long. Therefore, the number of the spiral blades 20 to the pile length can be decreased to improve a construction performance. Furthermore, the length $L_2$ between the uppermost-end intermediate blade 22 and the pile head portion 12 is set to be comparatively short, and hence the resistance force to the horizontal load can be enlarged.

When the length $L_1$ between the distal blade 21 and the lowermost-end intermediate blade 22 is smaller than twice as large as the length $L_2$ between the uppermost-end intermediate blade 22 and the pile head portion 12 and when the length $L_m$ between the intermediate blades 22 is smaller than three times as large as the length $L_2$ between the uppermost-end intermediate blade 22 and the pile head portion 12, the number of the spiral blades 20 to the pile length is unfavorably increased.

In the present embodiment, a flat and smooth bottom lid (not shown in the drawing) is attached to the distal portion 11 of the steel pipe pile main body 10, in place of an auxiliary metal fitting for drilling which has a pointed distal end. The auxiliary metal fitting for drilling is omitted in this manner, so that the ground or the soil cement column body 2 (FIG. 7) at a deeper position than the distal portion 11 of the pile can be prevented from being loosened, and a distal end support force can sufficiently be acquired. It is to be noted that the distal portion 11 of the steel pipe pile main body 10 can be placed in an open state without attaching the flat and smooth bottom lid thereto.

Figure 6:
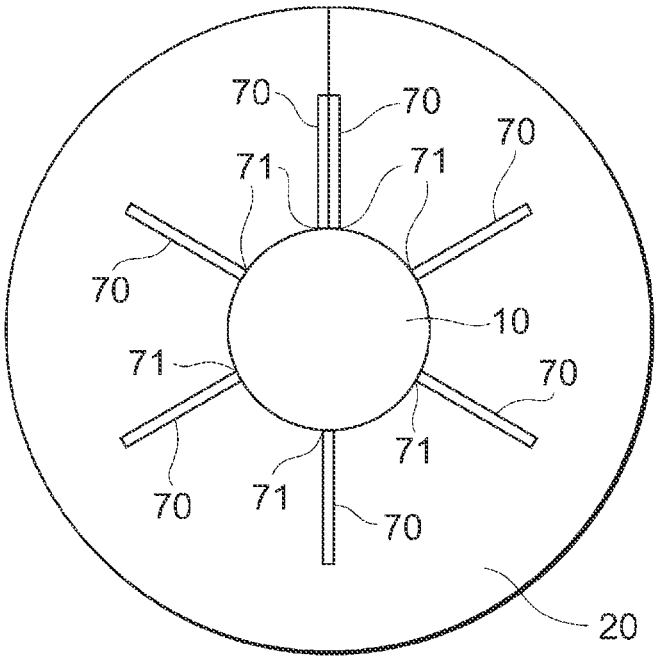
FIG. 6 is a top view showing a state where the reinforcing ribs shown in FIG. 5 are attached to the spiral blade.

Furthermore, in the present embodiment, such a reinforcing rib 70 as shown in FIGS. 5(A) to (C) is attached to an upper surface of the spiral blade 20 (each of the distal blade 21 and the intermediate blades 22). The reinforcing ribs 70 are plate-like members each possessing a substantially trapezoidal shape in planar view as shown in FIG. 5(A), and a plurality of (e.g., seven) reinforcing ribs are attached radially around the steel pipe pile main body 10 as shown in FIG. 6. In this case, each of the ribs is disposed so that a long side (a first side) 71 shown in FIG. 5(B) abuts on an outer peripheral surface of the steel pipe pile main body 10, the rib is disposed so that a short side (a second side) 72 shown in FIG. 5(C) is separated from the steel pipe pile main body 10, and the rib is disposed so that a side (a third side) 73 which is at right angles with the first side 71 and the second side 72 shown in FIG. 5(A) abuts on the upper surface of the spiral blade 20. Thus, the reinforcing ribs 70 are arranged, and hence when the present steel pipe pile 1 is twisted into the soil cement column body 2 (FIG. 7), it is possible to withstand a reaction force (bending moment) which acts from cement or the like. Therefore, a thickness of the spiral blade 20 can be decreased, and furthermore, a stirring effect can be obtained.

Meanwhile, when the reinforcing ribs 70 are attached to the steel pipe pile main body 10 and the spiral blades 20, the first sides 71 abut on the steel pipe pile main body 10, and the third sides 73 abut on the spiral blades 20. In this case, it is feared that, when the present steel pipe pile 1 is twisted into the soil cement column body 2, cement or the like is retained in a corner portion formed by the first side 71 and the third side 73 of each of the reinforcing ribs 70, and the insertion resistance increases. To solve such a problem, in the present embodiment, a notch portion 74 is formed in the corner portion formed by the first side 71 and the third side 73 of the reinforcing rib 70. Thus, the notch portion 74 is formed, and hence, when the present steel pipe pile 1 is twisted, it is possible to inhibit the cement or the like from being retained in the corner portion formed by the first side 71 and the third side 73 of the reinforcing rib 70, and it is possible to decrease the insertion resistance.

Figure 7:
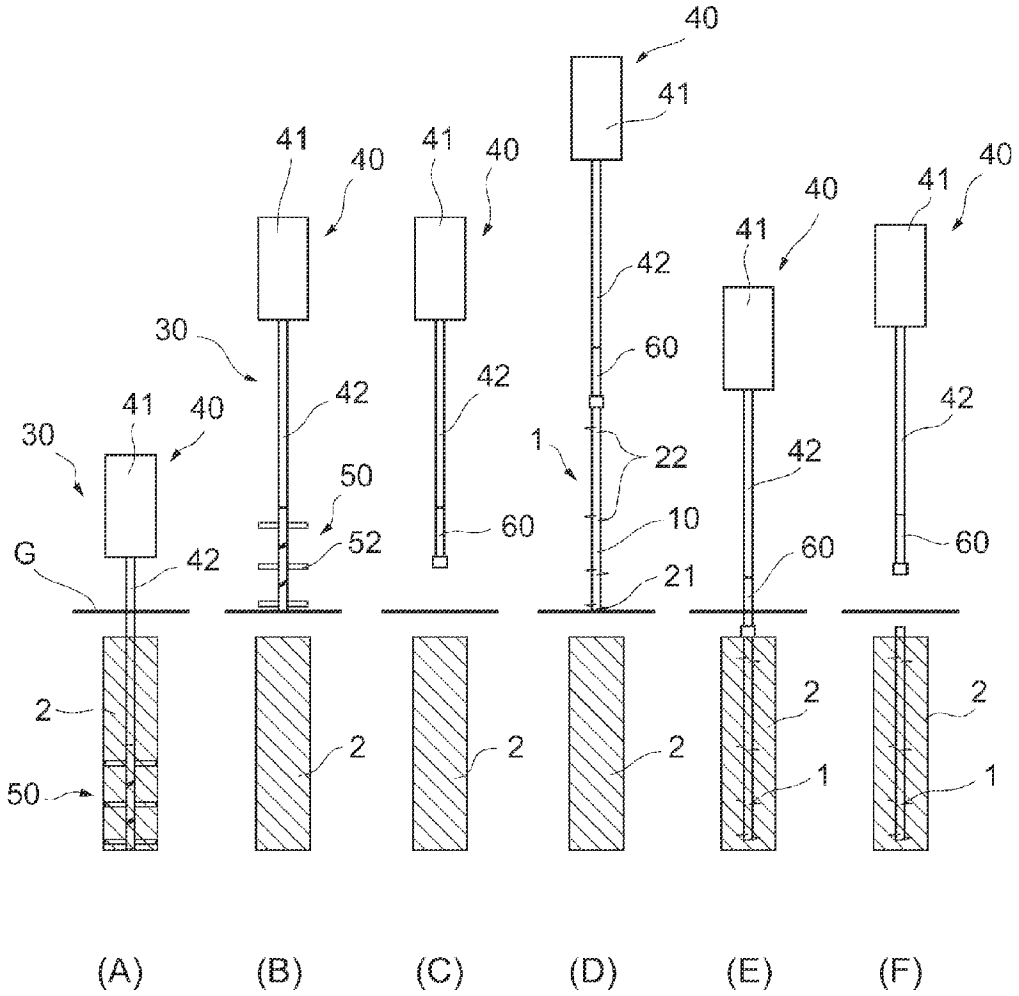
FIG. 7 is an explanatory view to explain a method of constructing a composite pile by use of the steel pipe pile with the spiral blades according to the embodiment of the present invention.
Figure 8:
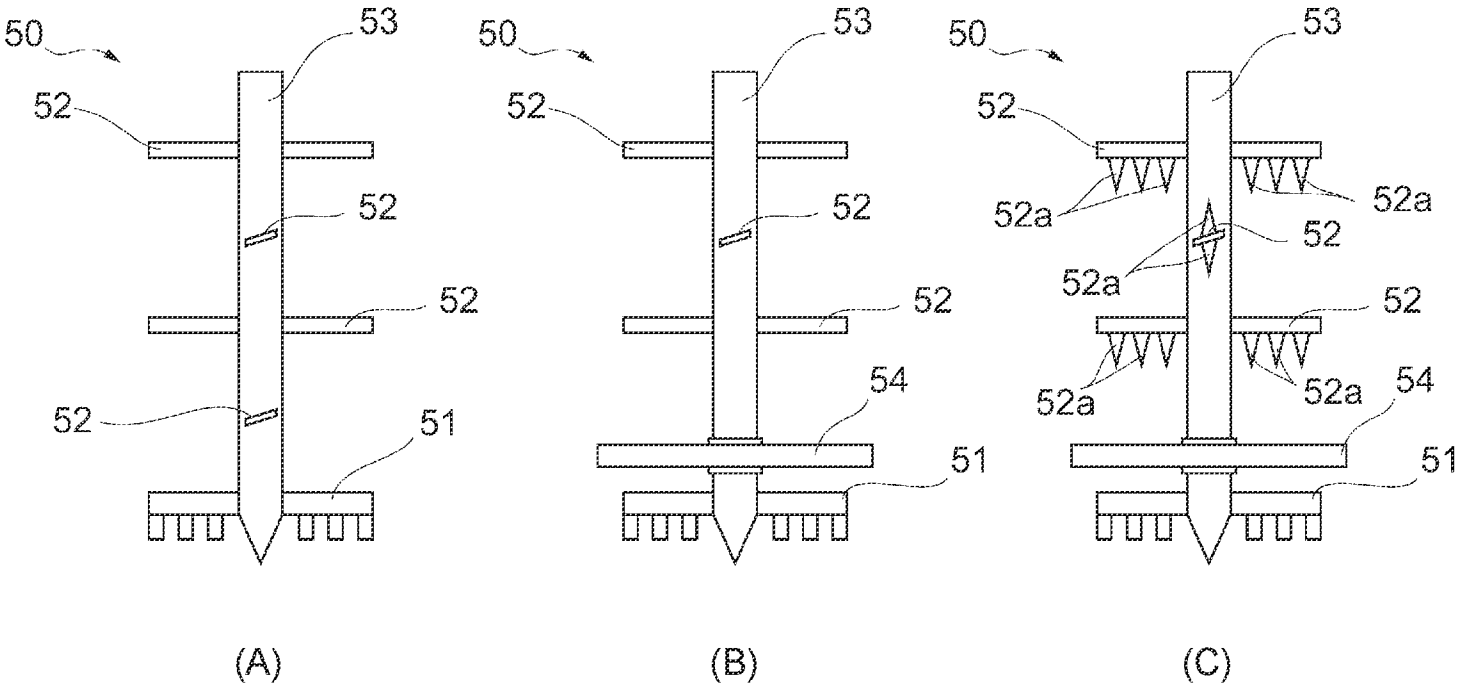
FIG. 8(A) is a constitutional view showing a constitution of a stirring mixing device for use in the construction method of the composite pile according to the embodiment of the present invention, and FIGS. 8(B) and (C) are constitutional views showing modifications of the stirring mixing device.

Next, a method of constructing a composite pile by use of the present steel pipe pile 1 will be described with reference to FIG. 7 and FIG. 8.

First, as shown in FIG. 7(A) and FIG. 7(B), a construction apparatus 30 is installed at a position of an object to be improved in ground G, and the soil cement column body 2 is constructed by a mechanical deep layer mixing treatment construction method (a column body constructing step). There can be employed the construction apparatus 30 comprising: a drive device 40 having an auger motor 41 and a rotary shaft 42 which transmits rotation of the auger motor 41; and a stirring mixing device 50 connected to the rotary shaft 42. As shown in FIG. 8(A), it is possible to employ the stirring mixing device 50 having a drilling blade 51, stirring blades 52, and a stirring shaft 53 connected to the rotary shaft 42 of the drive device 40. It is to be noted that the mechanical deep layer mixing treatment construction method is a ground improving construction method in which the ground G and slurry are mechanically stirred and mixed to construct the soil cement column body 2 by the stirring mixing device 50 having the drilling blade 51 and the stirring blades 52, while injecting the slurry prepared by kneading cement (or a solidifying material including the cement as a main component) and water into the ground G.

In addition to the drilling blade 51, the stirring blades 52 and the stirring shaft 53, as shown in FIG. 8(B) and FIG. 8(C), a co-rotation preventing blade 54 having a diameter larger than a drilling diameter is preferably attached to the stirring mixing device 50. In this way, the co-rotation preventing blade 54 is attached, so that the ground G and the slurry can efficiently be stirred and mixed by using the stirring mixing device 50. Furthermore, the stirring mixing device 50 preferably comprises a forward/backward rotation mechanism which rotates the stirring shaft 53 forward and backward. Furthermore, as shown in FIG. 8(C), each of the stirring blades 52 of the stirring mixing device 50 is provided with a plurality of drilling edges 52*a* parallel to an axial direction (an inserting direction). In this way, the drilling edges 52*a* are disposed in each of the stirring blades 52, so that a stirring and mixing treatment efficiency can be improved and high-speed construction can be realized to enable reduction of construction cost.

After the column body constructing step is performed, as shown in FIG. 7(C), the stirring mixing device 50 is removed from the drive device 40, and a jig 60 which rotates and inserts, under pressure, the present steel pipe pile 1 is attached to the drive device 40. Afterward, as shown in FIG. 7(D), the present steel pipe pile 1 is attached to the jig 60 (a steel pipe pile attaching step). Next, as shown in FIG. 7(E), the drive device 40 is driven to twist and insert the present steel pipe pile 1 into the soil cement column body 2 while rotating the present steel pipe pile (a pile inserting step). Subsequently, as shown in FIG. 7(F), the jig 60 is separated from the present steel pipe pile 1, and the steel pipe pile 1 is integrated with the soil cement column body 2, thereby constructing a soil cement composite pile in the ground G (a composite pile constructing step).

In the present embodiment, a length (a column extra length) from the deepest position of the soil cement column body 2 to a distal end position of the present steel pipe pile 1 in the constructed composite pile is set to 0.2 m or more. Therefore, a distal end support force of the composite pile can sufficiently be acquired. When the column extra length is smaller than 0.2 m, the sufficient distal end support force cannot be acquired, which is unfavorable.

First Embodiment

Subsequently, the result (a first embodiment) of a perpendicular loading test of composite piles constructed by using the present steel pipe pile 1 and the conventional pile 100, respectively, will be described with reference to FIG. 9. It is to be noted that the present test is conducted in the ground of Vietnam in which a clay layer, a silt layer and a sand layer are mixed down to a depth of about 20 m beneath the surface of the ground.

In the present steel pipe pile 1 employed in the present test, the diameter d of the steel pipe pile main body 10 is set to 165.2 mm, the diameter D of the spiral blade 20 is set to 500 mm (D=3.027 d), and a pile length is set to 6000 mm. On the other hand, in the conventional pile 100 employed in the present test, a diameter d of the steel pipe pile main body 110 is set to 216.3 mm, the diameter D of the spiral blade 120 is set to 500 mm (D=2.312 d), and a pile length is set to 6000 mm. The present steel pipe pile 1 and the conventional pile 100 were employed to construct composite piles each having a column diameter of 700 mm, and the perpendicular loading test was conducted.

Figure 9:
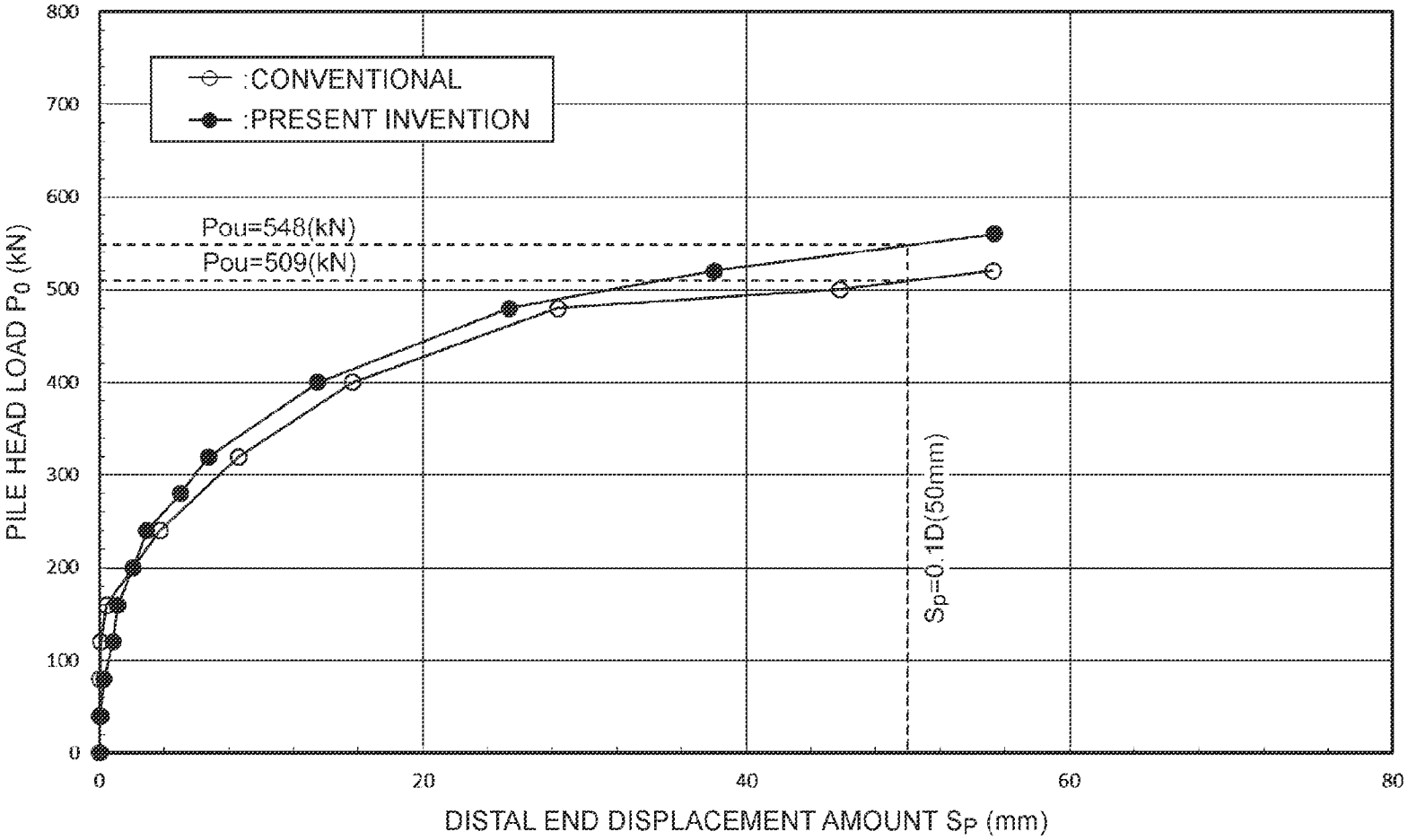
FIG. 9 is a graph showing the result of a perpendicular loading test of a composite pile according to a first embodiment of the present invention and a conventional composite pile.

A vertical axis in a graph of FIG. 9 shows a perpendicular load (a pile head load) Po applied to the pile head portion of the steel pipe pile main body, and a horizontal axis in the graph of FIG. 9 shows a displacement amount (a distal end displacement amount) Sp of the distal portion of the steel pipe pile main body. Furthermore, black dots in FIG. 9 show a plotted relation between the pile head load Po and the distal end displacement amount Sp in the composite pile constructed by using the present steel pipe pile 1, and white points in FIG. 9 show a plotted relation between the pile head load Po and the distal end displacement amount Sp in the composite pile constructed by using the conventional pile 100.

A pile head load Pou when the distal end displacement amount Sp reaches 10% (50 mm) of the diameter D (500 mm) of the spiral blade is 509 kN in the composite pile constructed by using the conventional pile 100, but is 548 kN in the composite pile constructed by using the present steel pipe pile 1 as shown in FIG. 9. In this way, a perpendicular support force of the composite pile constructed by using the present steel pipe pile 1 is substantially equal to a perpendicular support force of the composite pile constructed by using the conventional pile 100 (or is slightly above the perpendicular support force). This was clarified by the present test.

Second Embodiment

Subsequently, the result (a second embodiment) of a perpendicular loading test of a composite pile constructed by using the present steel pipe pile 1 will be described in comparison with a composite pile having an ideal support force with reference to FIG. 10. The present test is also conducted in the ground of Vietnam in which a clay layer, a silt layer and a sand layer are mixed down to a depth of about 20 m beneath the surface of the ground.

In the present steel pipe pile 1 employed in the present test, the diameter d of the steel pipe pile main body 10 was set to 219.1 mm, the diameter D of the spiral blade 20 was set to 700 mm (D=3.195 d), and a pile length was set to 6000 mm. In the present test, the present steel pipe pile 1 was employed to construct a composite pile having a column diameter of 1000 mm, and the perpendicular loading test was conducted.

Figure 10:
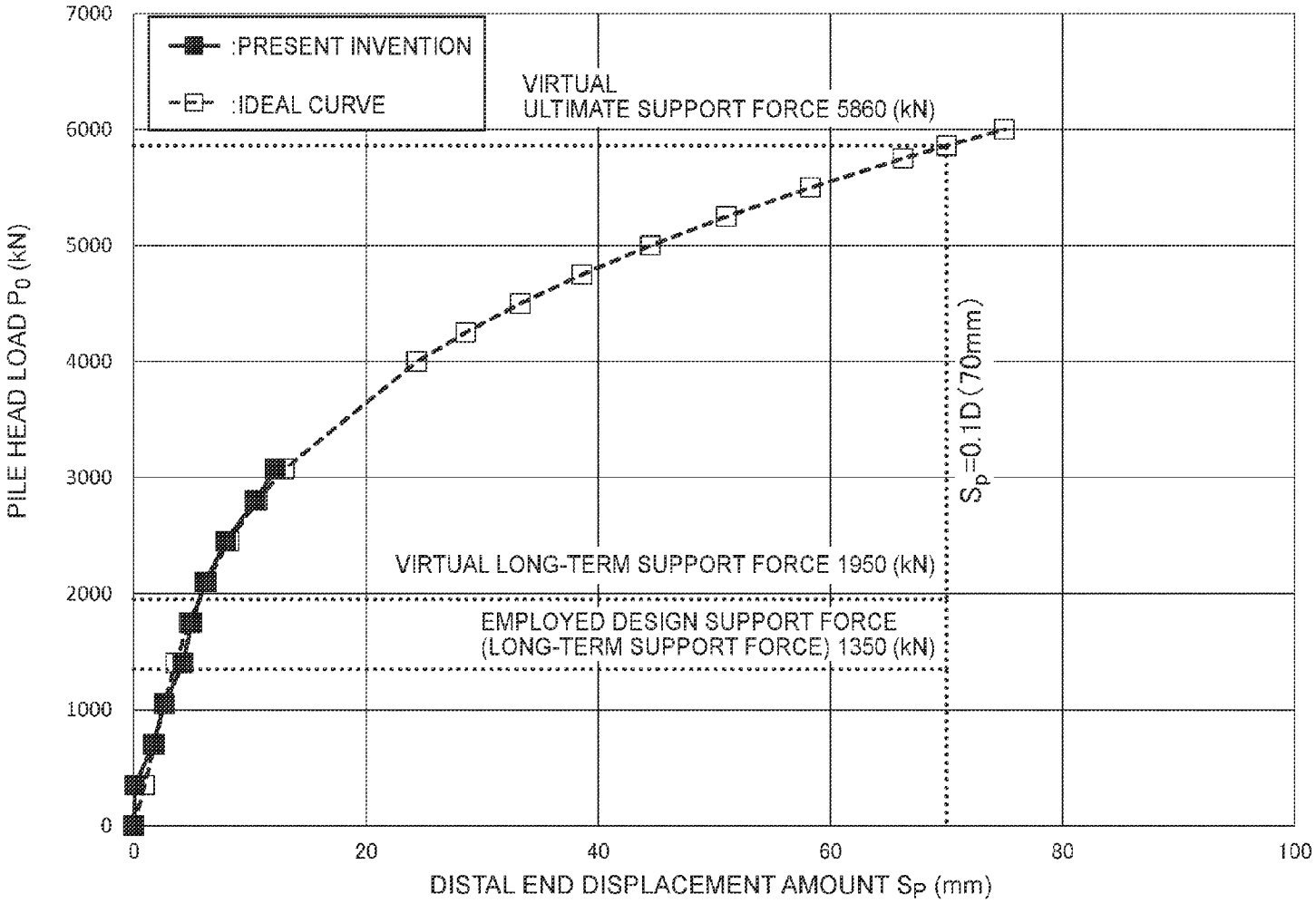
FIG. 10 is a graph showing the result of a perpendicular loading test of a composite pile according to a second embodiment of the present invention.

A vertical axis in a graph of FIG. 10 shows a perpendicular load (a pile head load) Po applied to the pile head portion of the steel pipe pile main body, and a horizontal axis in the graph of FIG. 10 shows a displacement amount (a distal end displacement amount) Sp of the distal portion of the steel pipe pile main body. Furthermore, black squares in FIG. 10 show a plotted relation between the pile head load Po and the distal end displacement amount Sp in the composite pile constructed by using the present steel pipe pile 1, and a curve in which white squares are connected in FIG. 10 is an Sp-Po approximate curve (ideal curve) of a composite pile having an ideal support force. Additionally, in the present test, the ideal curve was set on the basis of a virtual ultimate support force (a pile head load of 5860 kN when the distal end displacement amount Sp reaches 10% (70 mm) of the diameter D of the spiral blade).

It has been clarified that the Sp-Po curve of the composite pile constructed by using the present steel pipe pile 1 approximately overlaps with the ideal curve up to a value (about 3000 kN) which is noticeably above a virtual long-term support force (set to ⅓ of the virtual ultimate support force of 5860 kN). Furthermore, it has been clarified that the composite pile constructed by using the present steel pipe pile 1 has a margin ratio of about 30% to the virtual long-term support force (1950 kN) also in an employed design support force (1350 kN), and it has been clarified by the present test that the distal end displacement amount Sp is equal to that of the composite pile having the ideal support force.

Third Embodiment

Subsequently, an FEM analysis result (a third embodiment) of a perpendicular loading test of composite piles constructed by using the present steel pipe piles 1 (two types) will be described with reference to FIG. 11. Furthermore, it is assumed that the present test is conducted in the ground of Vietnam in which a clay layer, a silt layer and a sand layer are mixed down to a depth of about 20 m beneath the surface of the ground.

In a first present steel pipe pile (a first steel pipe pile) 1A employed in the present analysis, the diameter d of the steel pipe pile main body 10 was set to 175.0 mm, the diameter D of the spiral blade 20 was set to 700 mm (D=4.0 d), and a pile length was set to 6000 mm. On the other hand, in a second present steel pipe pile (a second steel pipe pile) 1B employed in the present analysis, the diameter d of the steel pipe pile main body 10 was set to 140.0 mm, the diameter D of the spiral blade 20 was set to 700 mm (D=5.0 d), and a pile length was set to 6000 mm. There was conducted the FEM analysis of the perpendicular loading test in a case where a composite pile having a column diameter of 1000 mm was constructed by employing each of these two types of steel pipe piles (the first steel pipe pile 1A and the second steel pipe pile 1B).

Figure 11:
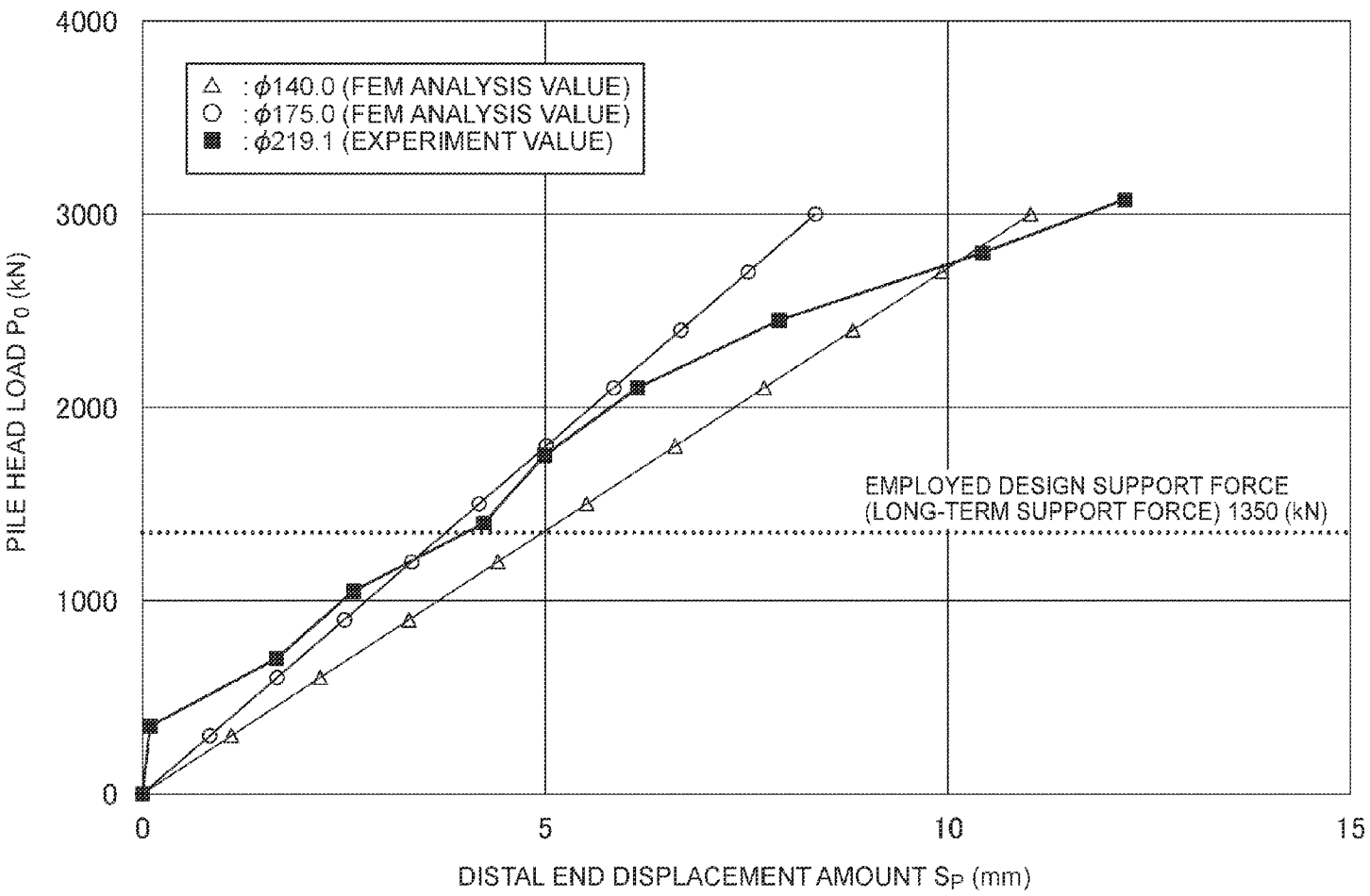
FIG. 11 is a graph showing an FEM analysis result of a perpendicular loading test of a composite pile according to a third embodiment of the present invention.

A vertical axis in a graph of FIG. 11 shows a perpendicular load (a pile head load) Po applied to the pile head portion of the steel pipe pile main body, and a horizontal axis in the graph of FIG. 11 shows a displacement amount (a distal end displacement amount) Sp of the distal portion of the steel pipe pile main body. Furthermore, black squares in FIG. 11 show a plotted relation between the pile head load Po and the distal end displacement amount Sp (the experiment result) in the composite pile constructed by using the present steel pipe pile 1 of the second embodiment, a curve in which white points are connected in FIG. 11 shows a plotted relation between the pile head load Po and the distal end displacement amount Sp (the FEM analysis result) in the composite pile constructed by using the first steel pipe pile 1A of the present embodiment, and a curve in which triangular points are connected in FIG. 11 shows a plotted relation between the pile head load Po and the distal end displacement amount Sp (the FEM analysis result) in the composite pile constructed by using the second steel pipe pile 1B of the present embodiment.

It has been clarified that the Sp-Po curve of the composite pile constructed by using the first steel pipe pile 1A (D=4.0 d) of the present embodiment approximately overlaps with the Sp-Po curve of the composite pile constructed by using the present steel pipe pile 1 of the second embodiment. That is, it has been clarified by the present analysis that the distal end displacement amount Sp of the composite pile constructed by using the first steel pipe pile 1A (D=4.0 d) is equal to (or is slightly smaller than) that of the present steel pipe pile 1 of the second embodiment in the employed design support force (1350 kN).

The Sp-Po curve of the composite pile constructed by using the second steel pipe pile 1B (D=5.0 d) of the present embodiment is also close to the Sp-Po curve of the composite pile constructed by using the present steel pipe pile 1 of the second embodiment. However, it has been clarified by the present analysis that the distal end displacement amount Sp of the composite pile constructed by using the second steel pipe pile 1B (D=5.0 d) is slightly larger than that of the present steel pipe pile 1 of the second embodiment in the employed design support force (1350 kN). That is, it is seen that the first steel pipe pile 1A (D=4.0 d) of the present embodiment has a higher support force than the second steel pipe pile 1B (D=5.0 d).

In the steel pipe pile (the present steel pipe pile) 1 with the spiral blades according to the above-mentioned embodiment, the diameter D of the spiral blade 20 is set to three times or more as large as the diameter d of the steel pipe pile main body 10, so that a peripheral area of the composite pile constructed by using the present steel pipe pile 1 can be enlarged. Therefore, the support force of the composite pile can be enhanced, and hence the soft ground can effectively be improved. In the conventional steel pipe pile (the conventional pile) 100 with the spiral blades, the upper limit of the diameter D of the spiral blade 120 is determined in consideration of a size of the insertion resistance caused by the comparatively firm ground of our country, and the lower limit of the diameter d of the steel pipe pile main body 110 which receives and holds a horizontal load is determined from the viewpoint of an earthquake resistance. Therefore, the diameter D of the spiral blade 120 is set to be from about 1.5 times to 2.5 times as large as the diameter d of the steel pipe pile main body 110. On the other hand, in the present steel pipe pile 1 assumed for the improvement of the comparatively soft ground of another country in which a clay layer and the like are present at deep positions of several ten meters beneath the surface of the ground, the insertion resistance or the earthquake resistance does not have to be taken into consideration. Therefore, the diameter D of the spiral blade 20 can relatively be enlarged, and the diameter d of the steel pipe pile main body 10 can relatively be reduced. Consequently, manufacturing costs (a material cost, etc.) of the steel pipe pile main body 10 can be decreased.

Furthermore, in the steel pipe pile (the present steel pipe pile) 1 with the spiral blades according to the above-mentioned embodiment, the length $L_1$ between the distal blade 21 and the lowermost-end intermediate blade 22 is set to 2.0 m or more, and the length $L_m$ between the intermediate blades 22 is set to 3.0 m or more (the length $L_1$ between the distal blade 21 and the lowermost-end intermediate blade 22 is set to twice or more as large as the length $L_2$ between the uppermost-end intermediate blade 22 and the pile head portion 12, and the length $L_m$ between the intermediate blades 22 is set to three times or more as large as the length $L_2$ between the uppermost-end intermediate blade 22 and the pile head portion 12). In this way, both of the length $L_1$ between the distal blade 21 and the lowermost-end intermediate blade 22 and the length $L_m$ between the intermediate blades 22 are set to be comparatively long, and hence the number of the spiral blades 20 to the pile length can be decreased to improve a construction performance (rise of an insertion speed, increase of a maximum construction length, reduction of a construction period and the like can be realized). Additionally, costs for a support force performance (a material cost, a welding cost, a processing cost, etc.) can remarkably be reduced. Furthermore, the length $L_2$ between the uppermost-end intermediate blade 22 and the pile head portion 12 is set to be comparatively short, and hence a resistance force to the horizontal load can be enlarged. As a result, it is possible to realize both of the improvement of the construction performance and maintenance of the support force. Furthermore, due to the decrease of the number of the spiral blades 20, a volume ratio of the steel pipe pile in the soil cement column body 2 decreases, and hence an amount of surplus soils to be generated decreases. As a result, a surplus soil treatment cost can be saved.

Furthermore, the steel pipe pile (present steel pipe pile) 1 with the spiral blades according to the above-mentioned embodiment comprises the plurality of plate-like reinforcing ribs 70 arranged radially around the steel pipe pile main body 10 on an upper surface of the spiral blade 20, and hence when the present steel pipe pile 1 is twisted into the soil cement column body 2, it is possible to withstand the reaction force (the bending moment) which acts from cement or the like. Therefore, the thickness of the spiral blade 20 can be decreased. Furthermore, the stirring effect can be obtained.

Furthermore, in the steel pipe pile (the present steel pipe pile) 1 with the spiral blades according to the above-mentioned embodiment, the notch portion 74 is formed in the corner portion formed by the first side 71 and the third side 73 of each of the reinforcing ribs 70. Therefore, when the present steel pipe pile 1 is twisted into the soil cement column body 2, it is possible to inhibit the cement or the like from being retained in the corner portion formed by the first side 71 and the third side 73 of the reinforcing rib 70, and it is possible to decrease the insertion resistance.

Furthermore, in the composite pile according to the above-mentioned embodiment, the length (the column extra length) from the deepest position of the soil cement column body 2 to the distal end position of the present steel pipe pile 1 is set to 0.2 m or more, and hence the distal end support force of the composite pile can sufficiently be acquired.

The present invention is not limited to the above embodiment, and this embodiment suitably designed and changed by a person skilled in the art is included in the gist of the present invention, as long as the embodiment comprises characteristics of the present invention. That is, respective elements of the above embodiment and an arrangement, materials, conditions, shapes, sizes and the like of the elements are not limited to illustrated ones and can suitably be changed (e.g., female and male spline joints can vertically be replaced). Furthermore, the respective elements of the above embodiment can be combined within a technically possible range, and any combination of these elements is also included in the gist of the present invention, as long as the characteristics of the present invention are included.

REFERENCE SIGNS LIST

1: steel pipe pile with spiral blades
2: soil cement column body
10: steel pipe pile main body
11: distal portion
12: pile head portion
20: spiral blade
21: distal blade
22: intermediate blade
70: reinforcing rib
71: first side
72: second side
73: third side
74: notch portion
d: diameter of steel pipe pile main body
D: diameter of spiral blade
G: ground
L1: length between distal blade and lowermost-end intermediate blade
L2: length between uppermost-end intermediate blade and pile head portion
Lm: length between intermediate blades

What is claimed is:

1. A construction method of a composite pile, which method comprises:

inserting a steel pipe pile into a soil and cement mixture column body constructed in the ground, the steel pipe pile comprising: a steel pipe pile main body; and spiral blades attached to the steel pipe pile main body, wherein:

a diameter of each of the spiral blades is set to three times or more as large as a diameter of the steel pipe pile main body;

the spiral blades include a distal blade located at a distal portion of the steel pipe pile main body, and intermediate blades located at portions of the steel pipe pile main body excluding the distal portion thereof;

a length between the distal blade and the intermediate blade adjacent to the distal blade is 2.0 m or more;

a length between the intermediate blades is uniformly 3.0 m or more and is greater than the length between the distal blade and the intermediate blade adjacent to the distal blade; and a length between the intermediate blade located at an uppermost position and a pile head portion of the steel pipe pile main body is 0.3 m or more and 0.5 m or less.

2. A composite pile, which pile comprises:

a steel pipe pile and a soil and cement mixture column body constructed in the ground;

the steel pipe pile comprising: a steel pipe pile main body; and spiral blades attached to the steel pipe pile main body, wherein:

a diameter of each of the spiral blades is set to three times or more as large as a diameter of the steel pipe pile main body;

the spiral blades include a distal blade located at a distal portion of the steel pipe pile main body, and intermediate blades located at portions of the steel pipe pile main body excluding the distal portion thereof;

a length between the distal blade and the intermediate blade adjacent to the distal blade is 2.0 m or more;

a length between the intermediate blades is uniformly 3.0 m or more and is greater than the length between the distal blade and the intermediate blade adjacent to the distal blade; and a length between the intermediate blade located at an uppermost position and a pile head portion of the steel pipe pile main body is 0.3 m or more and 0.5 m or less; and the steel pipe pile is inserted into the soil and cement mixture column body constructed in the ground.

3. The composite pile according to claim 2, wherein a length from the deepest position of the soil and cement mixture column body to a distal end position of the steel pipe pile is 0.2 m or more.

4. The steel pipe pile according to claim 2, wherein the length between the intermediate blades is greater than 3.0 m.

5. The steel pipe pile according to claim 2, wherein the length between the distal blade and the intermediate blade adjacent to the distal blade is five times or more as large as the length between the intermediate blade located at the uppermost position and the pile head portion of the steel pipe pile main body; and the length between the intermediate blades is six times or more as large as the length between the intermediate blade located at the uppermost position and the pile head portion of the steel pipe pile main body.

6. The steel pipe pile according to claim 2, wherein the diameter of each of the spiral blades is set to three times or more and four times or less as large as the diameter of the steel pipe pile main body.

7. The steel pipe pile according to claim 2, which comprises a plurality of plate reinforcing ribs arranged radially around the steel pipe pile main body on an upper surface of each of the spiral blades.

8. The steel pipe pile according to claim 7, wherein each of the reinforcing ribs possesses a substantially trapezoidal shape in planar view, each of the ribs is disposed so that a first side as its long side abuts on an outer peripheral surface of the steel pipe pile main body, each of the ribs is disposed so that a second side as its short side is separated from the steel pipe pile main body, each of the ribs is disposed so that a third side which is at right angles with the first side and the second side abuts on the upper surface of a respective one of the spiral blades, and a notch portion is formed in a corner portion formed by the first side and the third side.

* * * * *